US006130295A

United States Patent [19]

Yokota

[11] Patent Number: 6,130,295

[45] **Date of Patent: *Oct. 10, 2000**

[54] GOLF BALL

[75] Inventor: Masatoshi Yokota, Shirakawa, Japan

[73] Assignee: Sumitomo Rubber Industries, Ltd., Hgoyo-ken, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/883,444

[22] Filed: Jun. 26, 1997

[30] Foreign Application Priority Data

Jun. 26, 1996 [JP] Japan ..... 8-165871

[51] Int. Cl.[7] ..... A63B 37/12

[52] U.S. Cl. ..... 525/221; 525/201; 473/372; 473/378; 473/385

[58] Field of Search ..... 473/372, 378, 473/385; 525/201, 221

[56] References Cited

U.S. PATENT DOCUMENTS 4,931,376 6/1990 Ikematsu ..... 526/164
5,407,998 4/1995 Horiuchi ..... 525/221

FOREIGN PATENT DOCUMENTS 141113 6/1996 Japan .

*Primary Examiner*—David Buttner

[57] ABSTRACT

A golf ball having excellent rebound characteristics, excellent shot feel and good controllability at approach shot which contains a core and a cover formed on the core, wherein the cover is formed from a base resin mainly containing the mixture of an ionomer and polybutadiene having trans-1,4-structure of at least 60%.

5 Claims, No Drawings

GOLF BALL

FIELD OF THE INVENTION

The present invention relates to a golf ball. More particularly, it relates to a golf ball having excellent rebound characteristics, excellent shot feel and good controllability at approach shot.

BACKGROUND OF THE INVENTION

Recently, ionomer resins have been widely used as of cover material for golf balls (e.g. Japanese Patent Kokai Publication No. 49727/1974, etc.). This is because the ionomer resin is superior in rebound characteristics, durability, etc. and it is easily processed. However, since the ionomer resin has high rigidity and hardness, the resulting golf ball is poor in shot feel and controllability in comparison with balata (transpolyisoprene)-covered thread wound golf ball.

In order to improve shot feel and controllability of the ionomer-covered golf balls, it has been attempted to soften the ionomer resin by various means, but golf balls having sufficient performance have not been obtained. For example, Japanese Patent Kokai Publications Nos. 188270/1982, 54928/1994, 79017/1994, and the like propose that the ionomer resin is mixed with a rubber to soften it, but it is difficult to have stable physical properties depending on the variability of the state of crosslinking of the rubber.

OBJECTS OF THE INVENTION

A main object of the present invention is to provide a golf ball having excellent shot feel and good controllability, while maintaining excellent rebound characteristics inherent to ionomer resins.

According to the present invention, the object described above has been accomplished by employing a cover which is formed from a base resin mainly containing the mixture of an ionomer and polybutadiene having trans-1,4-structure of at least 60%.

SUMMARY OF THE INVENTION

The present invention provides a golf ball comprising a core and a cover formed on the core, wherein the cover is formed from a base resin mainly containing the mixture of an ionomer and polybutadiene having trans-1,4-structure of at least 60%.

DETAILED DESCRIPTION OF THE INVENTION

A cover is covered on a core to obtain the golf ball of the present invention. The core used may be either a core for thread wound golf ball (thread wound core) or a core for solid golf ball (solid core). The thread wound core is composed of a center and a thread rubber layer formed by winding the thread rubber in a stretched state around the center. The center may be a solid center of a vulcanized molded article of a rubber composition, or a liquid center wherein a liquid such as water, etc. is encapsulated in a center cover made of a vulcanized rubber. The solid core may be not only a core having a single-layer structure, that is uniform and integral, but also may be a core with a multi-layer structure having two or more layers. These are well known in the art. In order to simply explain the present invention, a two-piece golf ball using a uniform and integral solid core will be use hereinafter for explanation. The solid core may be obtained by vulcanizing or press-molding a rubber composition into a core of a typical two-piece golf ball. The rubber composition typically comprises a base rubber, a metal salt of an unsaturated carboxylic acid, an organic peroxide, a filler, and the like.

The base rubber can be natural rubber or synthetic rubber which has been conventionally used for solid golf balls. Preferred is high-cis polybutadiene rubber containing not less than 40 molar %, preferably not less than 80 molar % of a cis-1,4 bond. The base rubber can be mixed with natural rubber, polyisoprene rubber, styrene-butadiene rubber, EPDM, and the like.

The metal salt of the unsaturated carboxylic acid, which acts as a co-crosslinking agent, includes mono or divalent metal salts, such as zinc and magnesium salts of α,β-unsaturated carboxylic acids having 3 to 8 carbon atoms (e.g. acrylic acid, methacrylic acid, etc.). Preferred co-crosslinking agent is zinc acrylate because it imparts high rebound characteristics to the resulting golf ball. An amount of the metal salt of the unsaturated carboxylic acid in the rubber composition is preferably from 10 to 50 parts by weight, based on 100 parts by weight of the base rubber. When the amount of the metal salt of the unsaturated carboxylic acid is larger than 50 parts by weight, the core is too hard. Therefore, the shot feel is poor. On the other hand, when the amount of the metal salt of the unsaturated carboxylic acid is smaller than 10 parts by weight, the core is soft. Therefore, the rebound characteristics are degraded to reduce flight distance.

The organic peroxide, which acts as the crosslinking agent or curing agent, includes for example dicumyl peroxide, 1,1-bis (t-butylperoxy)-3,3,5-trimethylcyclohexane, 2,5-dimethyl-2,5-di(t-butylperoxy)-hexane, di-t-butyl peroxide and the like. Preferred organic peroxide is dicumyl peroxide. An amount of the organic peroxide is not limited, but is preferably from 0.5 to 5 parts by weight based on 100 parts by weight of the base rubber. When the amount of the organic peroxide is smaller than 0.5 parts by weight, the core is too soft. Therefore the rebound characteristics is degraded to reduce flight distance. On the other hand, when the amount of the organic peroxide is larger than 5 parts by weight, the core is too hard. Therefore the shot feel is poor.

The filler, which can be one used for a core of golf ball, includes for example, inorganic filler (such as zinc oxide, barium sulfate, calcium carbonate and the like), high specific gravity filler. (such as powdered tungsten, powdered molybdenum, and the like), and the mixture thereof. An amount of the filler is not limited and can vary depending on the specific gravity and size of the core and cover, but is preferably from 5 to 50 parts by weight based on 100 parts by weight of the base rubber. When the amount of the filler is smaller than 5 parts by weight, the core is too light. Therefore, the resulting golf ball is too light. On the other hand, when the amount of the filler is larger than 50 parts by weight, the core is too heavy. Therefore, the resulting golf ball is too heavy.

The rubber composition can contain other components which have been conventionally used for preparing the core of solid golf balls, such as antioxidants or peptizing agents.

In the present invention, the core obtained above is covered with a cover. The cover is formed from a base resin mainly containing a mixture of an ionomer and polybutadiene having trans-1,4-structure of at least 60%. The ionomer resin used in the present invention is not limited, but includes a copolymer of an α-olefin and an α,β-unsaturated carboxylic acid, of which a portion of the carboxylic acid groups is neutralized with a metal ion. As the α-olefins, ethylene and propylene are preferable. As the α,β-unsaturated carboxylic acid described above, acrylic acid, methacrylic acid, and the like are preferable. As the metal ion which neutralizes a portion of the carboxylic acid groups of a copolymer of an α-olefin and an α,β-unsaturated carboxylic acid, alkaline metal ions, such as sodium ions, potassium ions, lithium ions and the like; divalent metal ions, such as zinc ions, calcium ions, magnesium ions, and the like; trivalent metal ions, such as aluminum ions, neodymium ions, and the like; and the mixture thereof can be used. Sodium ions, zinc ions, lithium ions and the like are typically used, because of the rebound characteristics, durability and the like. The ionomer resin is not limited, but examples thereof will be shown by a trade name thereof. Examples of the ionomer resin, which is commercially available from Mitsui Du Pont Polychemical Co., include Hi-milan 1557, Hi-milan 1605, Hi-milan 1705, Hi-milan 1706, Hi-milan 1707, Hi-milan 1855 and Hi-milan 1856. Examples of the ionomer resin, which is commercially available from Exxon Chemical Co., include Iotek 7010 and Iotek 8000. These ionomer resins are used alone or in combination thereof.

The polybutadiene described above is a polymer which is formed by the polymerization of a butadiene as a monomer. Both 1,4-addition and 1,2-addition are produced by the addition polymerization of butadiene, and both the cis-1,4-structure and the trans-1,4-structure having the following formulae:

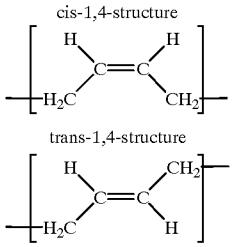

are formed among the 1,4-addition. It is not very necessary to consider the 1,2-addition, since the 1,4-addition occurs more preferentially than the 1,2-addition. However, various products are obtained depending on the type of catalyst selected for he polymerization, the method of polymerization utilized, and the like, between cis-1,4-structure and trans-1,4-structure. In the present invention, particularly the polybutadiene having a trans-1,4-structure of at least 60%, preferably 75 to 95% is used. The polybutadiene which has been conventionally used for preparing solid golf balls has the cis-1,4-structure much more than the trans-1,4-structure, and has the trans-1,4-structure in an amount of less than 2%. It is unexpected that the polybutadiene which has the trans-1,4-structure in a much higher amount than the trans-1,4-structure can be used for the cover of golf balls. When polybutadiene having a trans-1,4-structure is used in an amount of less than 60%, the hardness is too soft. Therefore, rebound characteristics is degraded. Polybutadiene having a trans-1,4-structure of at least 60% according to the present invention has a molecular weight of preferably 30,000 to 300,000, more preferably 50,000 to 200,000. When the molecular weight is less than 30,000, the physical properties, particularly the rebound characteristics is degraded. When the molecular weight is more than 300,000, the durability is degraded. Therefore, the processability, moldability and workability of the golf balls are degraded. Suitable examples of the polybutadiene, which are commercially available, for example, include "TP-049" (trade name) which are commercially available from Asahi Chemical Industries Co., Ltd.

In the cover formulation, a weight ratio (A:B) of ionomer resin (A) to polybutadiene having a trans-1,4-structure of at least 60% (B) is within the range from 99:1 to 50:50, preferably 98:2 to 70:30. When a weight ratio of (A) is more than the range, the effect of (B) is not sufficient. On the other hand, when a weight ratio (A) is less than this range, the rebound characteristics and durability are degraded from the level of (A).

Further, inorganic fillers and pigments for coloring can be optionally added to the cover composition, in addition to the resin component such as ionomer resin, etc.

The cover used in the present invention may optionally contain fillers (such as barium sulfate, etc.), pigments (such as titanium dioxide, etc.), and the other additives such as a UV absorber, a photostabilizer and a fluorescent agent or a fluorescent brightener, etc., in addition to the resin component, as long as the addition of the additives does not deteriorate the desired performance of the golf ball cover, but an amount of the colorant is preferably from 0.1 to 0.5 parts by weight.

The cover layer of the present invention is formed by a conventional method for forming a golf ball cover well known in the art, such as injection molding, pressure molding and the like. A thickness of the cover is preferably 1.0 to 2.5 mm. When the thickness is less than 1.0 mm, the cover is too thin to exhibit a properties of the cover. When the thickness is more than 2.5 mm, the hardness of the resulting golf ball is too large. Therefore, controllability and shot feel are degraded. When forming cover, many depressions called "dimples" are generally formed on the cover. The golf ball having a dimpled cover is then coated with paint to finish for serving commercial sell.

EXAMPLES

The following Examples and Comparative Examples further illustrate the present invention in detail but are not to be construed to limit the scope thereof.

Production of solid cores

A rubber composition for core shown in the formulation of Table 1 was kneaded and then was vulcanized under pressure at 150° C. for 30 minutes to obtain spherical solid cores having the diameter of 39.0 mm.

TABLE 1

| Kind | Parts by weight |
|---|---|
| BR11 *1 | 100 |
| Zinc acrylate | 30 |
| Zinc oxide | 20 |
| Dicumyl peroxide | 1.0 |
| Antioxidant *2 | 0.5 |

*1: Polybutadiene (trade name "BR-11") from Japan Synthetic Rubber Co., Ltd.
*2: Trade name "Yoshinox 425" from Yoshitomi Pharmaceutical Inds., Ltd.

Preparation of cover composition

The materials for cover shown in Table 2 were extruded using a kneading type twin-screw extruder to obtain pelletized cover compositions.

TABLE 2

| Kind | Example 1 | Example 2 | Example 3 | Comparative Example 1 | Comparative Example 2 |
|---|---|---|---|---|---|
| Hi-milan 1605 *3 | 45 | 35 | 25 | 50 | 20 |
| Hi-milan 1706 *4 | 45 | 35 | 25 | 50 | 20 |
| Hi-milan 1855 *5 | — | 25 | 30 | — | 60 |
| TP-049 *6 | 10 | 5 | 20 | — | — |
| Titanium dioxide | 2 | 2 | 2 | 2 | 2 |

*3: Hi-milan 1605 (trade name), ethylene-methacrylic acid copolymer ionomer resin obtained by neutralizing with sodium ion, manufactured by Mitsui Du Pont Polychemical Co., Ltd.
*4: Hi-milan 1706 (trade name), ethylene-methacrylic acid copolymer ionomer resin obtained by neutralizing with zinc ion, manufactured by Mitsui Du Pont Polychemical Co., Ltd.
*5: Hi-milan 1855 (trade name), ethylene-butyl acrylate-methacrylic acid terpolymer ionomer resin obtained by neutralizing with zinc ion, manufactured by Mitsui Du Pont Polychemical Co., Ltd.
*6: TP-049 (trade name), polybutadiene, manufactured by Asahi Chemical Industries Co., Ltd., average molecular weight = 80,000 to 130,000, content of trans-1,4-structure = 87%

Examples 1 to 3 and Comparative Examples 1 to 2

The core obtained above was directly covered by injection molding the cover composition to obtain golf balls having a weight of 45.4 g.

With respect to the resulting golf balls, ball compression (compression), coefficient of restitution, shot feel and controllability at approach shot were determined, and the results were shown in Table 3. The test method is as follows.

Test method (1) Ball compression

The ball compression of golf balls was measured by the ATTI measuring equipment.

(2) Coefficient of restitution

A metal cylinder having weight of 198.4 g struck against the golf ball, and the velocity of the cylinder and golf ball before and after strike were measured. The coefficient of restitution was calculated from the velocity and the weight of the cylinder and golf ball.

(3) Shot feel and controllability at approach shot

The resulting golf ball were evaluated by 10 top professional and top amateur golfers according to practical hitting test. The evaluation criteria are as follows.

Evaluation criteria o: Not less than 8 out of 10 golfers felt that the golf ball is good shot feel and spin is readily applied to stop ball easily.

Δ: 7 to 4 out of 10 golfers felt that the golf ball is good shot feel and spin is readily applied to stop ball easily.

x: Not more than 3 out of 10 golfers felt that the golf ball is good shot feel and spin is readily applied to stop ball easily.

TABLE 3

| Item | Example 1 | Example 2 | Example 3 | Comparative example 1 | Comparative example 2 |
|---|---|---|---|---|---|
| Compression (PGA) | 97 | 97 | 96 | 99 | 97 |
| Coefficient of restitution | 99 | 98 | 98 | 100 | 95 |
| Shot feel | ○ | ○ | ○ | X | Δ |
| Controllability at approach shot | ○ | ○ | ○ | X | Δ |

As is apparent from the physical properties of the golf balls of Examples 1 to 3 are comparative with those of the golf balls of Comparative Examples 1 to 2 shown in Table 3, the golf balls of the present invention have excellent shot feel and excellent controllability at approach shot without degrading coefficient of restitution.

In a golf ball comprising a core and a cover formed on the core, the golf ball, which the cover is formed from a base resin mainly containing the mixture of an ionomer and polybutadiene having trans-1,4-structure of at least 60%, has excellent rebound characteristics, excellent shot feel and good controllability at approach shot.

What is claimed is:

1. A golf ball comprising a core and a cover formed on the core, wherein said cover is unvulcanized and is formed from a base resin mainly containing a mixture of an ionomer and polybutadiene having a trans-1,4-structure of at least 60%.

2. The golf ball according to claim 1, wherein said polybutadiene has a trans=-1,4-structure of 75 to 95%.

3. The golf ball according to claim 1, where the polybutadiene has a molecular weight of 30,000 to 300,000.

4. The golf ball according to claim 1, wherein the weight ratio of the ionomer to the polybutadiene having a trans-1,4 structure of at least 60% is 99:1 to 50:50.

5. The golf ball according to claim 1, wherein the thickness of the cover is 1.0 to 2.5 mm.

* * * * *